US005551798A

United States Patent [19]

Goodreau

[11] Patent Number: 5,551,798

[45] Date of Patent: Sep. 3, 1996

[54] CULVERT END WALL RETAINER SYSTEM

[76] Inventor: Eugene A. Goodreau, 145 Queen Street North, Tilbury Ontario, Canada, N0P 2L0

[21] Appl. No.: 306,404

[22] Filed: Sep. 15, 1994

[51] Int. Cl.[6] ..... E01F 5/00

[52] U.S. Cl. ..... 405/124; 405/134

[58] Field of Search ..... 405/36, 52, 124, 405/125, 126; 138/105, 115, 119

[56] References Cited

U.S. PATENT DOCUMENTS

| | | | |
|---|---|---|---|
| 538,432 | 4/1895 | Nichols | 405/125 |
| 567,653 | 9/1896 | Parker | 405/126 X |
| 786,059 | 3/1905 | Simpson | 405/125 |
| 1,144,200 | 6/1915 | Howett | 405/125 |
| 1,213,916 | 1/1917 | Souder | 405/125 |
| 1,363,056 | 12/1920 | Riedl | 405/126 X |
| 1,412,616 | 4/1922 | Kammerer | 405/126 X |
| 2,636,352 | 4/1953 | Alger | 405/125 |
| 4,854,775 | 8/1989 | Lockwood | 405/124 X |

*Primary Examiner*—Frank S. Tsay

[57] ABSTRACT

Pre-fabricated end wall for culvert includes a novel pre-cast concrete slab shaped with an upper margin longer than the lower margin and with inclined side or end margins which are proximate the angle of repose of the culvert or ditch in which the culvert end walls are to be inserted. Each end wall defines an aperture into which mates or nests a conduit which is adapted to pass water from one end wall through the other end wall. Backfilling is the usual aggregate is compacted into and between the end walls to complete the culvert structure and if desired, a roadway surface may be placed over top of the same.

8 Claims, 1 Drawing Sheet

CULVERT END WALL RETAINER SYSTEM

This invention relates to a pre-fabricated culvert end wall retainer system.

BACKGROUND TO THE INVENTION

In the building of culverts which pass under the roadway and which are particularly used for the drainage of waters from one side of the roadway to the other, it has been common to use corrugated steel tubing as the conduit means for the culvert and then to build a backfill structure either with rock, gravel or in some cases the actual pouring in situ of concrete side walls or wings and then backfilling between the side walls with appropriate aggregate and then asphalt or other appropriate roadway covering media such as gravel, asphalt, concrete or the like.

THE INVENTION

I have conceived of a pre-fabricated method of building culvert side walls, the shape thereof to be determined by the width and depth of the culvert. Each side wall itself is precast concrete and has its own base portion and plurality of eyelets on the inside surface of the wall so that stainless steel rod runners or wire can be extended therebetween to hold the side walls in vertical position. The side walls can then be backfilled with aggregate or gravel or the like and then the upper margin thereof surfaced with a suitable road top to complete the culvert.

The invention contemplates, a culvert with end wall retainers comprising opposite culvert end walls each composed of a rigid member having an upper margin, opposite end margins and a base margin and each end wall retainer defining an aperture in close proximity with the base margin, each rigid member carrying at least a connection means; means for interconnecting the connection means carried by one rigid member to that of the opposite rigid member; a conduit communicating with and extending between the apertures and fill means extending between the base margin and the upper margin and between the respective end margins of each rigid member overcovering the conduit. Particularly, the culvert end walls are constructed of pre-cast concrete and have stainless constraining means holding the walls in essentially parallel upright position and where backfill may be aggregate or other convenient material.

The invention further contemplates a method of fabricating an in situ culvert in which, or over which, a roadway is postured over an indentation or valley in the ground which may, from time to time, pass over water thereunder comprising the steps of selecting opposite culvert end walls from a rigid material, the end walls having an upper margin, opposite end margins, and a base margin and defining an aperture in close proximity with the base margin, attaching connection means to each end wall, placing, in situ, each end wall in a generally orthogonal position to the valley in which they are to be positioned, interconnecting between opposite culvert end walls, an interconnecting means, extending between each aperture of each end wall a communicating conduit from the exterior surface of one end wall to the opposite exterior side surface of the other end wall, backfilling the space defined between the two opposite culvert end walls to a pre-determined grade or level above and about the conduit so as to structure an in situ culvert.e invention will now be described by way of example and reference to the accompanying drawings in which:

BRIEF DESCRIPTION OF THE DRAWINGS

The invention will now be described by way of example and reference to the accompanying drawings, in which.

Figure 1:
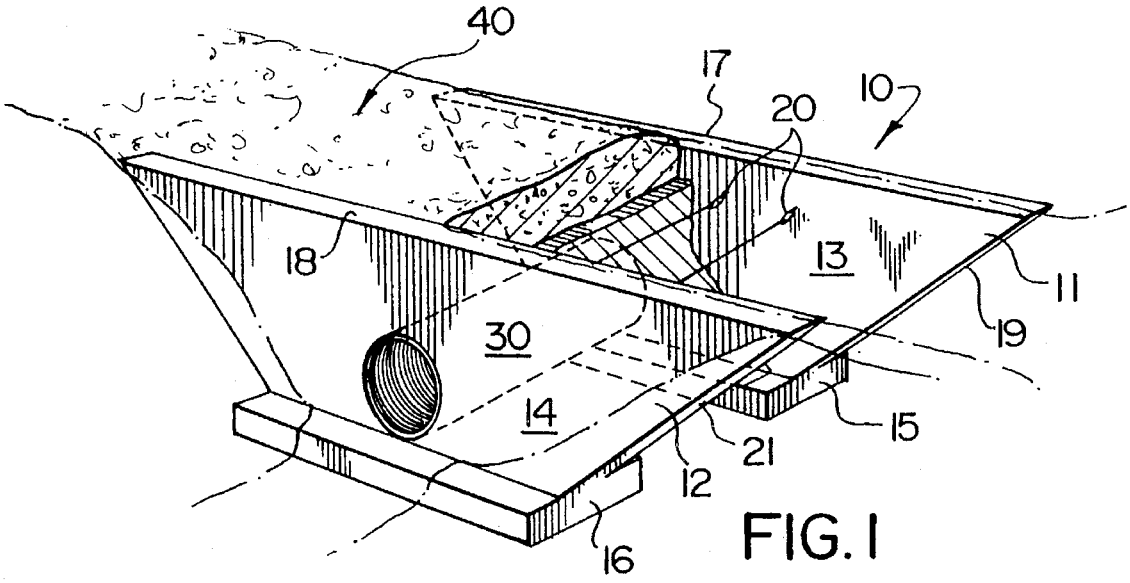
FIG. 1 is a perspective view, partially in assembly, of a culvert end wall retainer system according to my invention.

The culvert end wall retainer system is generally shown as (10) in FIG. 1 and consists of two mirror side walls (11) and (12), each respectively composed of a vertical section (13, 14) and an orthogonally oriented base portion or slab (15) and (16).

Figure 2:
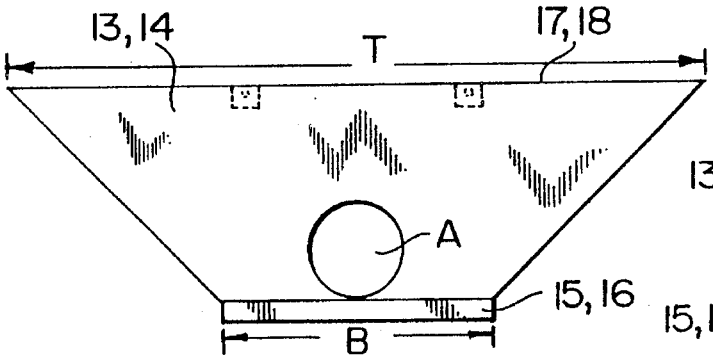
FIG. 2 is a side elevational view of one of the side walls.
Figure 3:
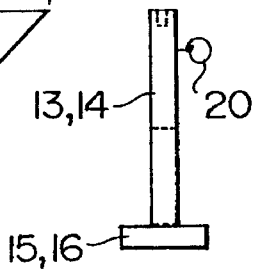
FIG. 3 is an end elevational view of the side wall of FIG. 2.

The vertical sections (13,14) have respective tops (17) and (18) and inclined ends (19) and (21). The slope that the ends (19) and (20) respectively mate with their base slabs (15,16) will depend upon the depth of the culvert to be constructed. Similarly, the length of the shorter base piece (15,16), shown with dimension (B) in the side view of FIG. 2, will depend as to how wide the base of the drainage region for the culvert is to be. It can be varied. So can the top dimension (T) so as to accommodate the upper shoulder width of the drainage ditch in which the culvert rests. Each mirror side wall (11,12) defines a drainage aperture (A), and now referring back to FIG. 1, the apertures (A) in communication with a corrugated steel pipe (30) extending between the mirror side walls (11) and (12) through which the water and other drainage material will pass.

Figure 4:
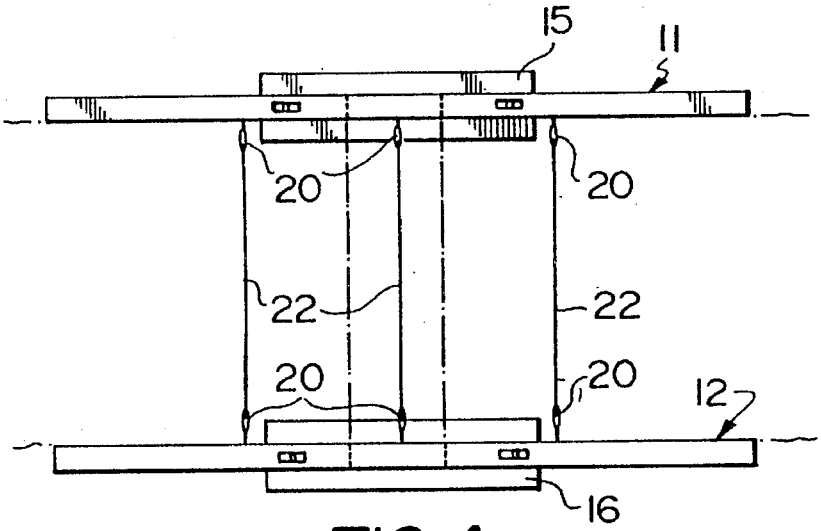
FIG. 4 is a top plan view of the side walls assembled prior to backfilling the plenum between the side wall with aggregate.

On the inside surfaces of each mirror side wall (11) and (12) are spatially disposed stainless loops or hooks (20). They are embedded into the sections (13) and (14) during casting. After casting the end walls (11,12), they are relocated to the culvert site and erected vertically, as illustrated in the perspective FIG. 1; and, stainless steel wires or rods (22) are extended from one loop (20) to the opposite loop (20) in the other mirror wall, in the fashion illustrated in FIG. 4. Thereafter, and now referring to FIG. 1, the space between the side walls can be filled with the necessary aggregate, generally shown as (40) in that figure and thereafter a topping put on, if required, for instance gravel, asphalt or concrete in order to provide the bearing surface for the roadway.

I claim:

1. A culvert with unitary end walls that act as soil retainers comprising:

(a) opposite culvert end walls each of precast concrete formed into a rigid member having, an upper margin, a base margin and with opposite end margins each rigid member defining an aperture in close proximity with the base margin, and carrying at least a connection means positioned a predetermined distance from the base margin;

(b) means for interconnecting the connection means carried by one rigid member to that of the opposite rigid member;

(c) a conduit communicating with and extending between the apertures such that there is defined a void bounded by the base margins the upper margins and the respective end margins of each rigid member, the void adapted for earth filling that overcovers the conduit.

2. The culvert as claimed in claim 1, wherein the connection means are loops embedded in and constrained by the concrete rigid members.

3. The culvert as claimed in claim 2, wherein the base margin has an integral base element disposed generally orthogonal to the upper margin.

4. The culvert as claimed in claim 3, wherein connection means are of stainless steel loops and the means for interconnecting is stainless steel wire wrappingly engaged on opposite loops.

5. The culvert as claimed in claim 2, wherein the connection means and the means for interconnecting (b) are stainless steel.

6. The culvert as claimed in claim 1, wherein the base margin is shorter than the upper margin.

7. A method of fabricating an in situ culvert in which or over which a roadway is to be postured over an indentation or valley in the ground which may, from time to time, pass water therethrough comprising the steps of:

(a) precasting from concrete, at least two opposite culvert end walls, the end wall having an upper margin, a base margin, each with respective opposite ends, and defining an aperture in close proximity with the base margin, (b) attaching connection means to each end wall at a predetermined distance from the base margin;

(c) placing, in situ, each end wall in a generally orthogonal position to the valley in which they are to be positioned, (d) interconnecting between connection means of each opposite culvert end wall, an interconnecting means, (e) extending between each aperture of each end wall a conduit communicating the apertures; and, (f) backfilling that void defined between the two opposite culvert end walls to a pre-determined grade or level above and about the conduit so as to structure an in situ culvert.

8. The method as claimed in claim 7, wherein the precasting step precasts the end wall with a shorter base margin than the upper margin.

* * * * *